US005980313A

United States Patent [19]

Kunishi et al.

[11] Patent Number: 5,980,313

[45] Date of Patent: Nov. 9, 1999

[54] SYSTEM FOR MOUNTING AN ELECTRICAL CONNECTOR ON A PANEL

[75] Inventors: Shinsuke Kunishi, Hadano; Katsutoshi Tojo, Machida, both of Japan

[73] Assignee: Molex Incorporaed, Lisle, Ill.

[21] Appl. No.: 09/046,190

[22] Filed: Mar. 23, 1998

[30] Foreign Application Priority Data

Jun. 20, 1997 [JP] Japan ..... 9-180675

[51] Int. Cl.[6] ..... H01R 13/73

[52] U.S. Cl. ..... 439/545

[58] Field of Search ..... 439/544, 545, 439/607, 567, 557

[56] References Cited

U.S. PATENT DOCUMENTS

| | | | |
|---|---|---|---|
| 4,241,972 | 12/1980 | Ayer | 339/126 R |
| 4,312,558 | 1/1982 | Duerr et al. | 339/130 R |
| 4,527,849 | 7/1985 | Marach | 339/59 M |
| 4,813,885 | 3/1989 | Colleran et al. | 439/565 |
| 4,878,639 | 11/1989 | Tempco | 248/73 |
| 4,921,435 | 5/1990 | Kane et al. | 439/248 |
| 4,990,094 | 2/1991 | Chandler et al. | 439/544 |
| 5,192,227 | 3/1993 | Bales | 439/532 |
| 5,709,569 | 1/1998 | Buck et al. | 439/607 |

FOREIGN PATENT DOCUMENTS

| | | | |
|---|---|---|---|
| 4136667C1 | 4/1993 | Germany | H01R 13/73 |

*Primary Examiner*—Michael L. Gellner
*Assistant Examiner*—Briggitte R. Hammond
*Attorney, Agent, or Firm*—Stephen Z. Weiss

[57] ABSTRACT

A system is provided for mounting an electrical connector on a rear side of a panel having a hole through which the connector can mate with a complementary mating connecting device. The system includes a bracket having a body positionable against the rear side of the panel. The body has an aperture alignable with the hole in the panel. A plurality of flanges are arranged in a U-shape and project rearwardly of the body about the aperture for receiving the connector in an insertion direction generally parallel to the rear side of the panel. An electrical connector has a mating end positionable onto the flanges in the insertion direction and includes a mating portion alignable with the aperture in the bracket. Complementary interengaging latches are provided between the mating end of the connector and the flanges for holding the connector on the bracket.

11 Claims, 4 Drawing Sheets

SYSTEM FOR MOUNTING AN ELECTRICAL CONNECTOR ON A PANEL

FIELD OF THE INVENTION

This invention generally relates to the art of electrical connectors and, particularly, to a system, including a mounting bracket, for mounting an electrical connector on a side of a panel.

BACKGROUND OF THE INVENTION

It is known to provide a variety of systems for mounting an electrical connector on a panel, such as on a rear side of a panel. For instance, personal computers are connected with peripheral devices, such as a printer and the like, by electrical connectors mounted on a rear panel of the computer body. When connecting such peripheral devices as a printer on the computer, the connectors are mounted on the rear panel by a fairly permanent mounting means. That is because the printer will not be frequently connected and disconnected. For instance, screws often are used to mount the connector onto the rear side of the panel.

On the other hand, it is desirable to connect such devices as a video camera, a digital still camera or the like on the computer body by a more releasable mounting system so that such devices can be readily connected and disconnected. In addition, such peripheral devices preferably are connected and disconnected at a front panel of the computer body where it is undesirable to have such non-aesthetic mounting means as screws projecting from the front of the computer.

It would be desirable to have a system wherein an electrical connector is mounted to a rear side of a panel, such as a front panel of a computer, and the peripheral device can be mated through a hole in the front panel with the connector mounted on the rear side of the panel. When the peripheral device is disconnected, the hole can be easily covered by an aesthetically pleasing cover. The present invention is directed to satisfying this need and solving the various problems inherent therewith.

SUMMARY OF THE INVENTION

An object, therefore, of the invention is to provide a new and improved system for mounting an electrical connector on a panel, such as a rear side of a panel having a hole through which the connector can mate with a complementary mating connecting device.

In the exemplary embodiment of the invention, the system includes a bracket having a body positionable against the rear side of the panel. The body has an aperture alignable with the hole in the panel. Generally U-shaped flange means project rearwardly of the body about the aperture for receiving the connector in an insertion direction generally parallel to the rear side of the panel. An electrical connector has a mating end positionable onto the flange means in the insertion direction. The connector has a mating portion alignable with the aperture in the bracket. Complementary interengaging latch means are provided between the mating end of the connector and the flange means for holding the connector on the bracket.

As disclosed herein, the body of the bracket is generally planar. The flange means comprises a bottom flange and a pair of side flanges disposed at three sides of the aperture. Each flange is generally L-shaped in cross-section defined by a first leg portion projecting rearwardly of the body and a second leg portion projecting inwardly toward the aperture spaced from the body.

The complementary interengaging latch means are provided between the mating end of the connector and the side flanges. Specifically, a resilient latch arm is provided on opposite sides of the mating end of the connector. Each resilient latch arm has a latch hook engageable in a latch opening in a respective one of the side flanges.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
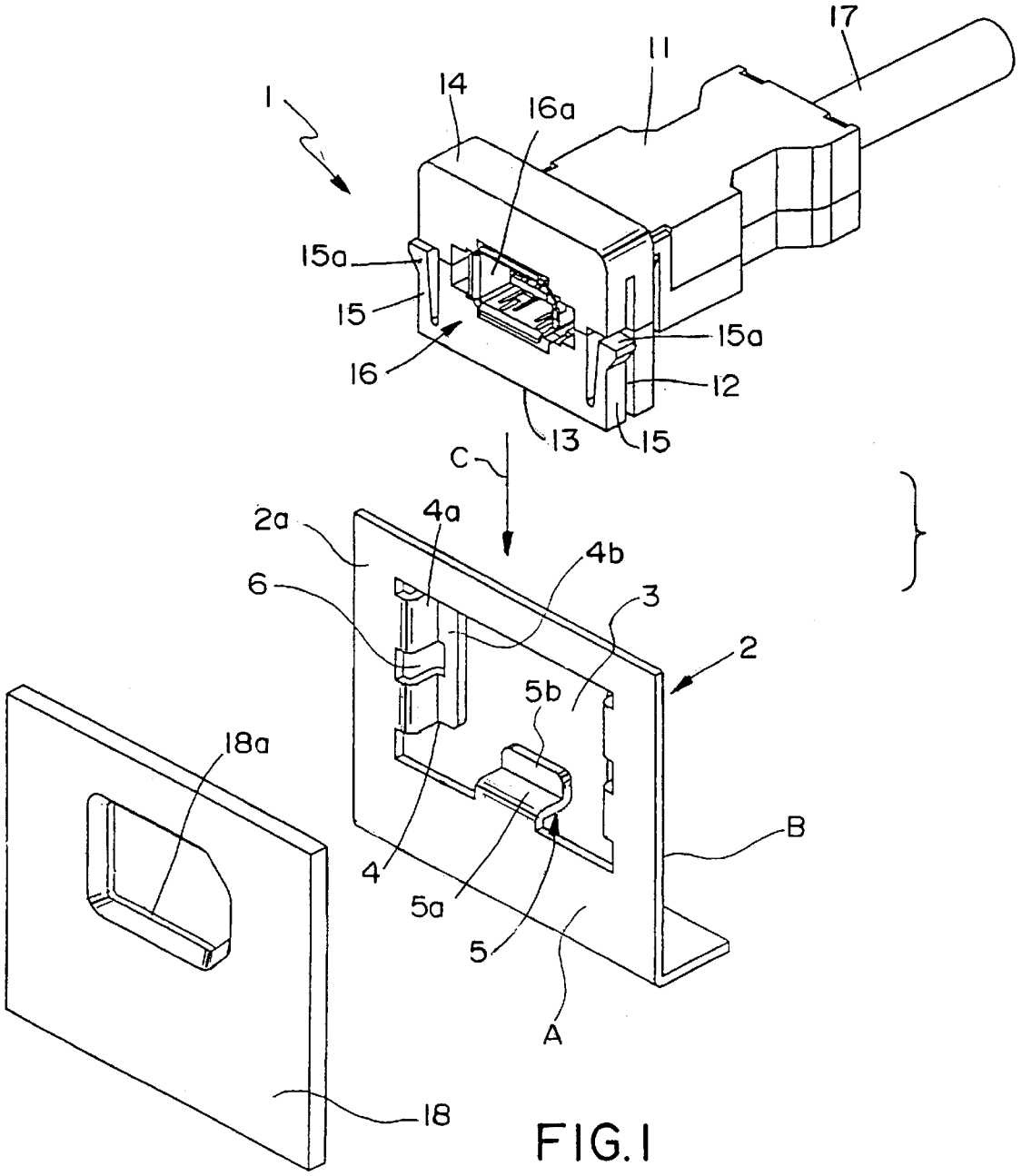
FIG. 1 is an exploded perspective view of the mounting system of the invention.
Figure 6:
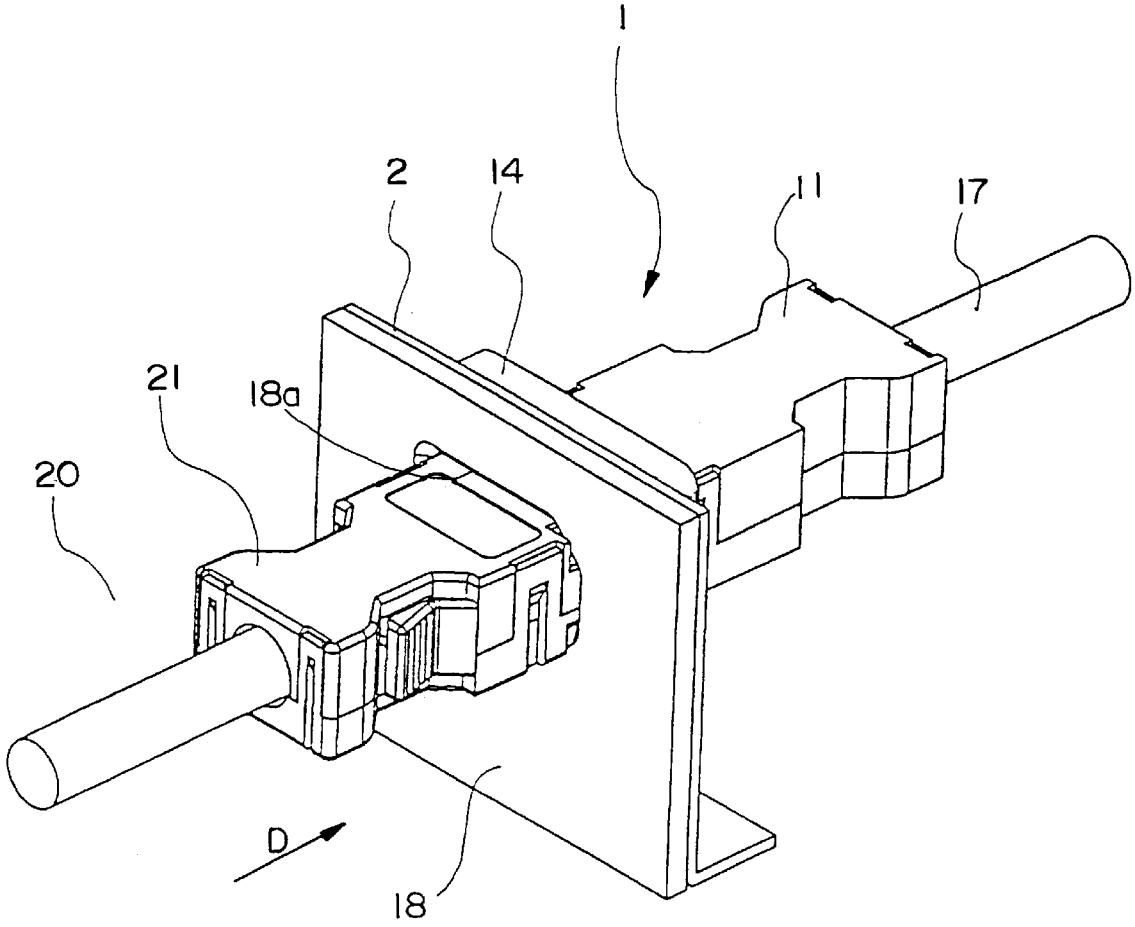
FIG. 6 is a view similar to that of FIG. 2, with a complementary mating connector mated with the electrical connector.

Referring to the drawings in greater detail, and first to FIG. 1, the invention is embodied in a mounting system, generally designated 1, which includes a mounting bracket or a portion of a panel, generally designated 2, for mounting an electrical connector 11 on the rear side of a panel. If a bracket is used, which is separate from the panel (not shown) then the panel will have a hole through which the connector can mate with a complementary mating connecting device, as seen in FIG. 6 and described hereinafter.

Mounting bracket 2 includes a generally planar body 2*a* defining a front face "A" and a rear face "B". The body has an aperture 3 alignable with the hole in the panel. Generally, mounting bracket 2 includes generally U-shaped flange means projecting from rear face "B" of body 2*a* about aperture 3 for receiving connector 11 in an insertion direction generally parallel to the rear side of the panel, i.e. generally parallel to planar body 2*a*. The insertion direction is indicated by arrow "C" in FIG. 1.

More particularly, the flange means is provided by a pair of side flanges, generally designated 4, and a bottom flange, generally designated 5. Each of the flanges 4 and 5 is generally L-shaped in cross-section defined by first leg portions 4*a* and 5*a* projecting rearwardly of body 2*a*, and second leg portions 4*b* and 5*b* projecting inwardly toward aperture 3 spaced from the body. Each side flange 4 has a latch opening 6 completely through its leg portion 4*a*.

Figure 2:
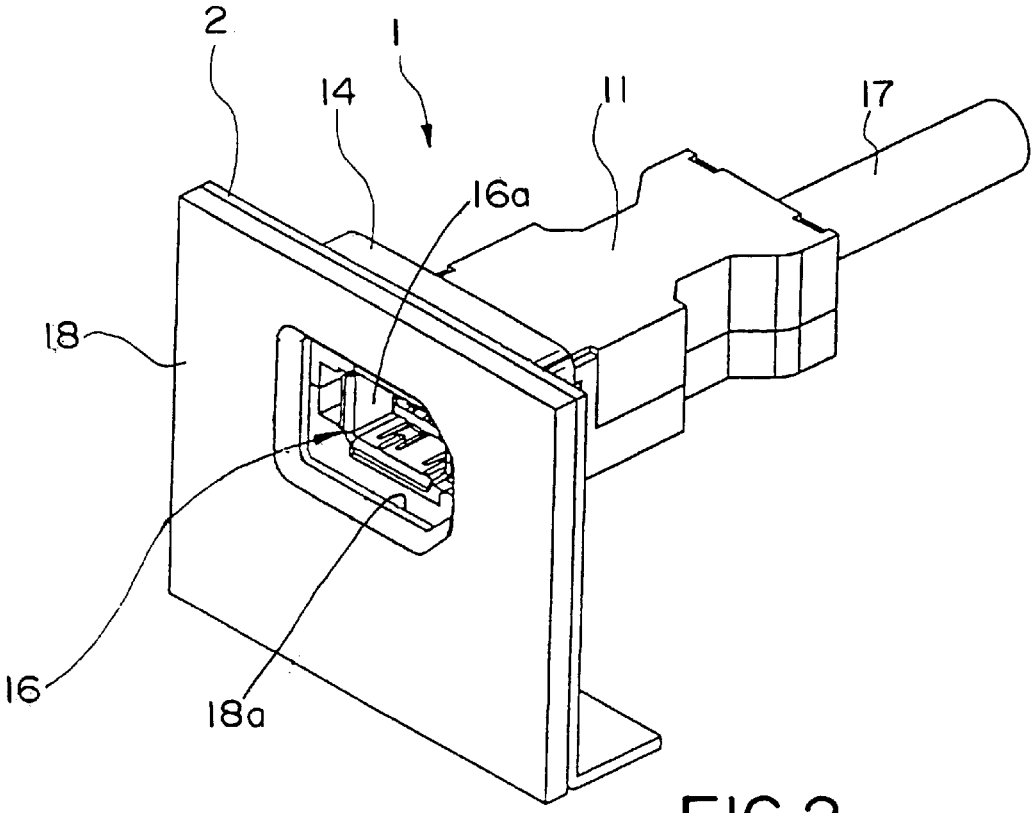
FIG. 2 is a front perspective view of the mounting system.
Figure 3:
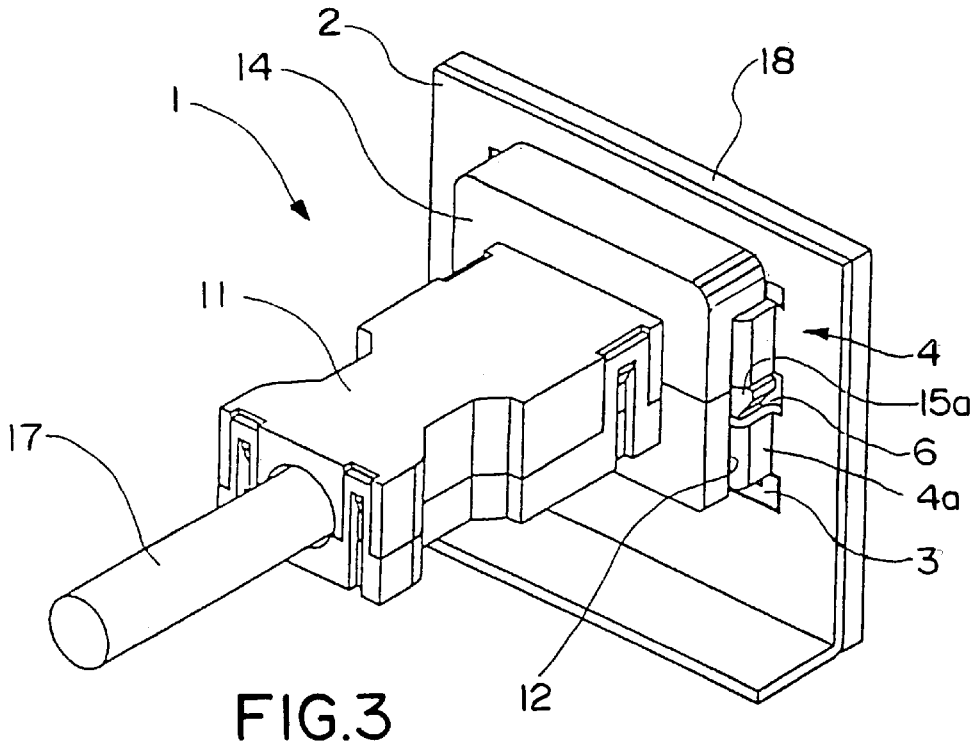
FIG. 3 is a rear perspective view of the mounting system.

Referring to FIGS. 2 and 3 in conjunction with FIG. 1, electrical connector 11 mounts a plurality of terminals (not shown) terminated to discrete conductors of an electrical cable 17 projecting from the rear of the connector. The connector has a front mating end 14 in the form of a peripheral, outwardly projecting flange-like end. The mating end defines a mating portion, generally designated 16.

Specifically, the mating portion is formed by a receptacle 16*a* for receiving a plug mating portion of the complementary mating connecting device. A pair of resilient or flexible latch arms 15 are formed on each opposite side of mating end 14 of the connector. Each flexible latch arm 15 terminates in a latch hook 15*a* at the distal end thereof. Lastly, a groove 12 is formed in each opposite side of mating end 14 of the connector.

As stated above, connector 11 is mounted to the rear of bracket 2 in the direction of arrow "C" (FIG. 1). During mounting, inwardly directed leg portions 4*b* of flanges 4 slide into grooves 12 on opposite sides of mating end 14 of the connector. When the connector bottom 13 contacts leg portion 5*a* of bottom flange 5 as shown in FIGS. 2 and 3, latch hooks 15*a* of flexible latch arms 15 snap into latch openings 6 in side flanges 4 to hold the connector mounted on the bracket. Latch hooks 15*a* are chamfered or angled on their bottom surfaces so that they are biased inwardly upon engagement with the tops of side flanges 4 when the connector is inserted into the flanges of the bracket. FIG. 3 clearly shows how latch hooks 15*a* snap back outwardly into locking engagement within latch openings 6.

Figure 4:
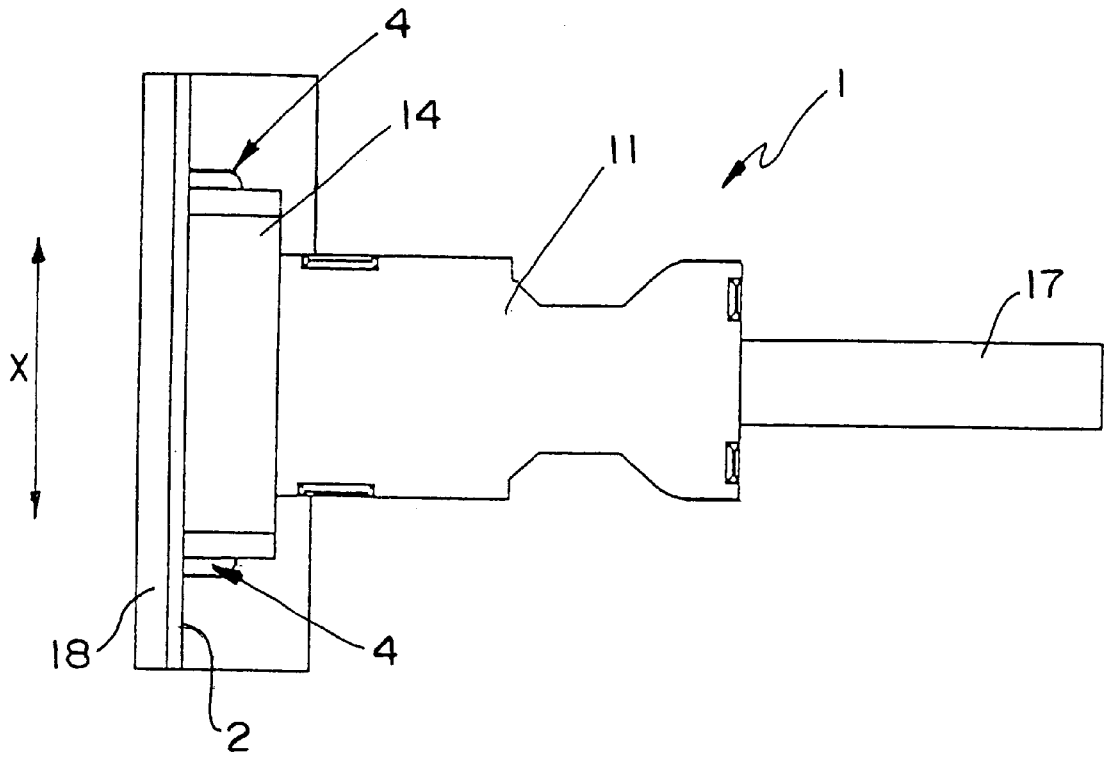
FIG. 4 is a top plan view of the mounting system.

Referring to FIG. 4, it can be understood that electrical connector 11 is prevented from moving laterally or horizontally in the direction of double-headed arrow "X" because side flanges 4 embrace mating end 14 of the connector and prevent any side movement of the connector relative to the bracket and panel.

Figure 5:
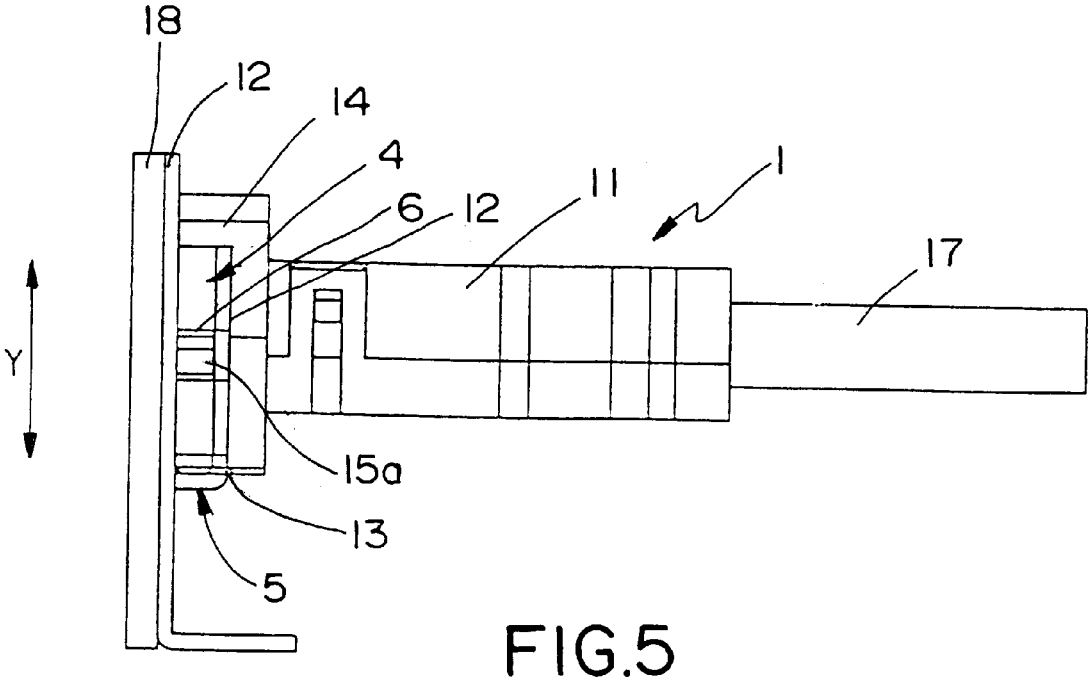
FIG. 5 is a side elevational view of the mounting system.

FIG. 5 shows that electrical connector 11 is prevented from moving up or down in the direction of double-headed arrow "Y" by the locking engagement of latch hooks 15*a* within latch openings 6. Bottom flange 5 further provides rigid support for the connector in the downward direction.

A cover 18 is mountable to front face "A" of bracket or partial panel 2 (FIG. 1) to cover at least the peripheral areas of aperture 3 and to provide an aesthetically pleasing appearance at least at the front of the mounting system. The cover has an opening 18*a* through which a plug portion of the complementary mating connecting device is inserted into receptacle 16*a* of connector 11.

FIG. 6 shows a complementary mating connecting device, generally designated 20, mated with connector 11 through opening 18*a* in cover 18 and through aperture 3 in bracket or partial panel 2, and into receptacle 16*a* of connector 11. The complementary mating connecting device has a forwardly projecting connector plug 21. The mating connector is connected to connector 11 in the direction of arrow "D". It should be understood that the mounting system of the invention is not limited to use with a bracket 2 mounted to the rear side of a panel about a hole in the panel. Body 2*a* actually could be part of the panel, itself. Therefore, connector 11 would be mounted within flanges 4 and 5 at the rear side of the panel, and cover 18 would be positionable against the front side of the panel.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. Means for mounting an electrical connector on a rear side of a panel having a hole through which the connector can mate with a complementary mating connecting device, comprising:

flange means formed integrally as a portion of the panel projecting rearwardly of the panel about the hole for receiving the connector in an insertion direction in a plane generally parallel to the rear side of the panel;

the electrical connector having a mating end positionable between said flange means in said insertion direction and including a mating portion alignable with the hole in the panel; and complementary interengaging latch means on said mating end of the connector engageable with said flange means for holding the connector on the panel.

2. The mounting means of claim 1 wherein said flange means comprises a bottom flange and a pair of side flanges disposed at three sides of the hole.

3. The mounting means of claim 2 wherein said side flanges are generally L-shaped in cross-section defined by first leg portions projecting rearwardly of the panel and second leg portions projecting inwardly toward the hole spaced from the panel.

4. The mounting means of claim 1 wherein said complementary interengaging latch means comprises a resilient latch arm on the mating end of the connector.

5. The mounting means of claim 4 wherein said resilient latch arm has a latch hook engageable in a latch opening in the flange means.

6. Means for mounting an electrical connector on a rear side of a panel having a hole through which the connector can mate with a complementary mating connecting device, comprising:

a bracket having a generally planar body positionable against said rear side of the panel, the body having an aperture alignable with said hole in the panel, a bottom flange and a pair of side flanges disposed at three sides of the aperture for receiving the connector in an insertion direction in a plane generally parallel to the rear side of the panel, each of said flanges including a first leg portion projecting rearwardly of the body and a second leg portion projecting inwardly toward the aperture spaced from the body;

the electrical connector having a mating end positionable between said flanges in said insertion direction and including a mating portion alignable with the aperture in the bracket; and complementary interengaging latch means on said mating end of the connector engageable with said side flanges for holding the connector on the bracket.

7. The mounting means of claim 6 wherein said mating portion of the electrical connector comprises a receptacle for receiving a complementary mating connecting plug.

8. The mounting means of claim 6, including a cover positionable against a front side of the panel and having an opening alignable with the hole in the panel and the aperture in the bracket.

9. The mounting means of claim 6 wherein opposite sides of the mating end of the electrical connector include grooves for receiving the second leg portions of said side flanges.

10. The mounting means of claim 6 wherein said complementary interengaging latch means comprise flexible latch arms at opposite sides of the mating end of the connector.

11. The mounting means of claim 10 wherein said flexible latch arms have latch hooks engageable in latch openings in said side flanges.

* * * * *